US010774524B2

(12) United States Patent
Song

(10) Patent No.: US 10,774,524 B2
(45) Date of Patent: Sep. 15, 2020

(54) ASSEMBLABLE PANEL STRUCTURE

(71) Applicant: Jong Woon Song, Gwangju (KR)

(72) Inventor: Jong Woon Song, Gwangju (KR)

(73) Assignee: Jong Woon Song, Gwangju (KR)

( * ) Notice: Subject to any disclaimer, the term of this patent is extended or adjusted under 35 U.S.C. 154(b) by 0 days.

(21) Appl. No.: 16/221,777

(22) Filed: Dec. 17, 2018

(65) Prior Publication Data

US 2020/0190792 A1 Jun. 18, 2020

(51) Int. Cl.
*E04B 1/00* (2006.01)
*E04B 1/61* (2006.01)

(52) U.S. Cl.
CPC ..... *E04B 1/615* (2013.01); *E04B 2001/6195* (2013.01)

(58) Field of Classification Search
CPC ..... E04B 1/615; E04B 1/6195; E04H 7/30; E04H 4/0018
USPC ..... 52/79.5, 79.7, 652.1, 656.9
See application file for complete search history.

(56) References Cited

U.S. PATENT DOCUMENTS 2,755,517 A * 7/1956 Sickel ..... B60P 3/34 52/71
3,720,022 A * 3/1973 Dattner ..... E04B 1/34815 52/79.7
3,791,080 A * 2/1974 Sjoberg ..... B63B 3/08 52/79.4
3,871,146 A * 3/1975 Hamy ..... E01D 1/00 52/79.7
4,672,779 A * 6/1987 Boyd ..... E04H 15/001 52/71
4,910,932 A 3/1990 Honigman
5,463,833 A * 11/1995 Banez ..... E04B 1/344 52/69
2007/0006544 A1* 1/2007 Washburn ..... A01G 13/105 52/588.1
2009/0282772 A1* 11/2009 McGlinchy ..... E06B 3/667 52/656.9

(Continued)

FOREIGN PATENT DOCUMENTS

EP 2455305 A1 * 5/2012 ..... E04H 7/30
EP 2527548 A1 11/2012

(Continued)

OTHER PUBLICATIONS

Examination Report No. 1 for Australian Patent Application No. 2018279039, dated Nov. 21, 2019, 7 pages.

(Continued)

*Primary Examiner* — Beth A Stephan
(74) *Attorney, Agent, or Firm* — Brooks, Cameron & Heubsch, PLLC

(57) ABSTRACT

The present invention relates generally to an assemblable panel structure and, more particularly, to an assemblable panel structure having an expansion module connectable to a core module in an expansive manner. The assemblable panel structure includes a core module comprised of an upper core panel and a lower core panel, each having a regular thickness and a polygon horizontal-section wherein the core module has a space defined therein between the upper core panel and the lower core panel which are spaced apart from each other. The present invention adopts a modular structure, thus making it possible to quickly complete various types of prefabricated houses.

9 Claims, 8 Drawing Sheets

(56) References Cited

U.S. PATENT DOCUMENTS

2012/0151851 A1* 6/2012 Cantin ..... E04B 1/34305
52/79.5
2012/0311939 A1* 12/2012 Barragan Olaya ..... E04B 1/344
52/79.5

FOREIGN PATENT DOCUMENTS

| | | | |
|---|---|---|---|
| KR | 1020090102128 | A | 9/2009 |
| KR | 1020140090039 | A | 10/2014 |
| KR | 1020170121972 | A | 11/2017 |
| KR | 1020180003298 | A | 1/2018 |
| WO | 2004/101903 | A2 | 11/2004 |

OTHER PUBLICATIONS

Examination Report No. 2 for Australian Patent Application No. 2018279039, dated Apr. 6, 2020, 5 pages.

* cited by examiner

ASSEMBLABLE PANEL STRUCTURE

BACKGROUND OF THE INVENTION

Field of the Invention

The present invention relates generally to an assemblable panel structure and, more particularly, to an assemblable panel structure having an expansion module connectable to a core module in an expansive manner.

Description of the Related Art

A house has long served as the foundation on which mankind can maintain settled life.

The types of houses include an apartment, a detached house, a prefabricated house, and the like.

Such an apartment or a detached house is mostly a concrete structure.

Such a concrete structure is robust but is impossible to move once built and has a limited ability for structural modification.

For example, in order to expand a completed concrete structure, it is necessary to install the steel frame again and cure the concrete again.

This causes the construction period to be prolonged.

The technology that has emerged to shorten the construction period is the prefabricated house.

In construction technology, the prefabricated house is constructed using panels which are pre-manufactured and assembled to complete a house structure.

However, a prefabricated house in the related art has required separate processing of the panels to be assembled according to the design.

Accordingly, extra construction time and cost associated with panel processing may be required.

Furthermore, much time and effort have been required for the finishing work to maintain the airtightness between the panels to be assembled.

This is because panel shapes vary depending on the design of the prefabricated house, and the finishing work is required to be separately performed according to the connection between the panels having various shapes.

However, the prefabricated house in the related art may have poor heat insulation performance as compared with a concrete house.

Furthermore, when the prefabricated house in the related art which has been completed as designed is required to be expanded, a separate design is required again.

This is because the prefabricated house in the related art differs from the concrete structure only in that the construction method is a prefabricated type, and a separate design, a separate panel processing, and a separate coupling operation are required, which may be complicated, costly, and time consuming.

Furthermore, the prefabricated house in the related art may be difficult to move for installation once completed.

SUMMARY OF THE INVENTION

Accordingly, the present invention has been made keeping in mind the above problems occurring in the related art, and an objective of the present invention is to provide an assemblable panel structure having an expansion module connectable to a core module in an expansive manner.

In order to accomplish the above objective, according to an aspect of the present invention, there is provided an assemblable panel structure, including: a core module comprised of an upper core panel and a lower core panel, each having a regular thickness and a polygonal horizontal-section, wherein the core module has a space defined therein between the upper core panel and the lower core panel which are spaced apart from each other.

Furthermore, the core module may be configured such that predetermined portions thereof including multiple vertexes in the polygonal section are chamfered, outer side surfaces may be formed along a periphery of each of the chamfered upper and lower core panels, and expansion modules may be provided such that the number of expansion modules that are connectable to the core module may be equal to one half of the number N of the outer side surfaces.

Furthermore, each of the expansion modules may have a rectangular parallelepiped shape, and the rectangular parallelepiped may be configured such that a vertical-section thereof has a regular thickness in four directions and a space is defined therein.

Furthermore, the expansion module may be configured such that a first end portion thereof is in surface contact with the outer side surfaces.

According to the present invention as described above, the following effects can be obtained.

First, the adoption of a modular structure makes it possible to quickly complete various types of prefabricated houses.

Second, the adoption of the modular structure also makes it possible to facilitate removal and movement for installation.

Third, the use of the side panel makes it possible to simplify the coupling between the modules.

Fourth, the adaption of an outer frame detachably coupled makes it possible to simply and effectively maintain the airtightness between the core module and the expansion module.

DESCRIPTION OF THE EMBODIMENTS

Figure 1:
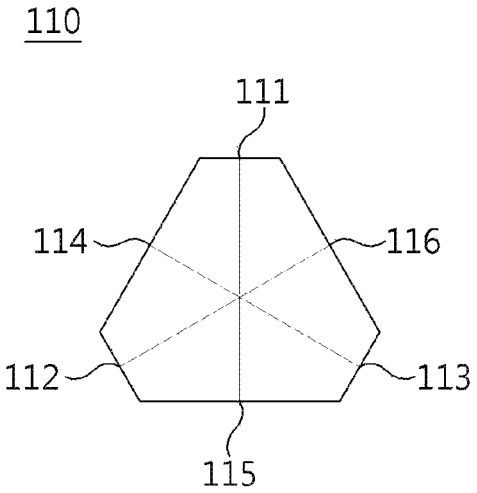
FIG. 1 is a top view showing an upper core panel 110 according to one embodiment of the present invention.

Reference will now be made in detail to various embodiments of the present invention, specific examples of which are illustrated in the accompanying drawings and described below, since the embodiments of the present invention can be variously modified in many different forms. While the present invention will be described in conjunction with exemplary embodiments thereof, it is to be understood that the present description is not intended to limit the present invention to those exemplary embodiments. On the contrary, the present invention is intended to cover not only the exemplary embodiments, but also various alternatives, modifications, equivalents and other embodiments that may be included within the spirit and scope of the present invention as defined by the appended claims.

Throughout the drawings, the same reference numerals will refer to the same or like parts.

It will be understood that, although the terms "first", "second", etc. may be used herein to describe various elements, these elements should not be limited by these terms. These terms are only used to distinguish one element from another element.

For instance, a first element discussed below could be termed a second element without departing from the teachings of the present invention. Similarly, the second element could also be termed the first element. The term "and/or" includes any and all combinations of one or more of the associated listed items.

Unless otherwise defined, all terms including technical and scientific terms used herein have the same meaning as commonly understood by one of ordinary skill in the art to which the present invention belongs.

It should be understood that the terms defined by the dictionary are identical with the meanings within the context of the related art, and they should not be ideally or excessively formally defined unless the context clearly dictates otherwise in this specification.

FIG. 1 is a top view showing an upper core panel 110 according to one embodiment of the present invention.

Figure 2:
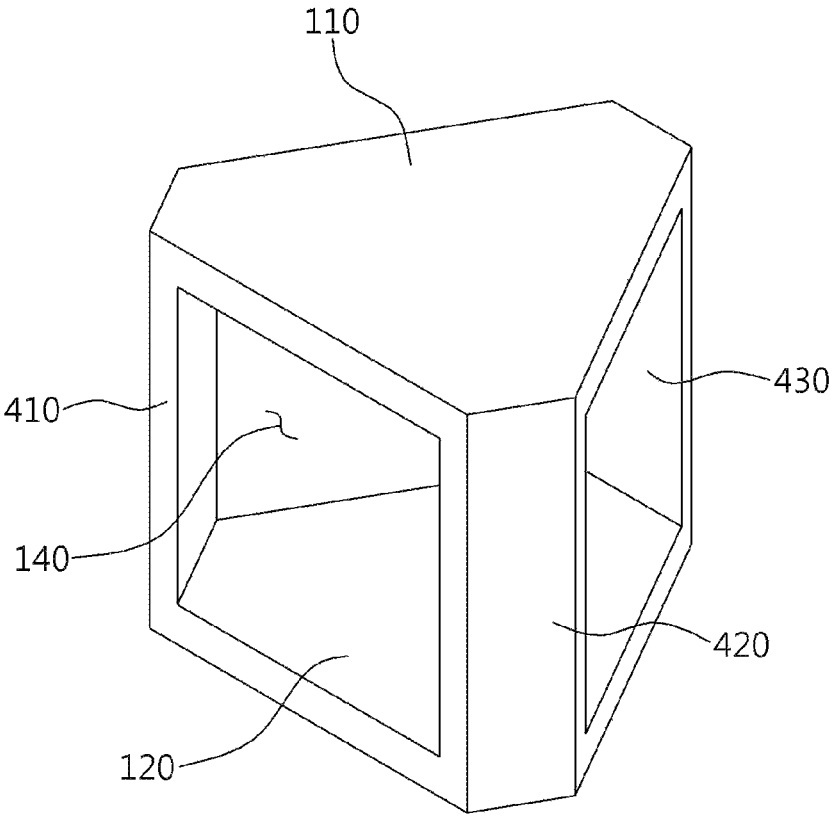
FIG. 2 is a perspective view showing a core module 100 according to one embodiment of the present invention.

FIG. 2 is a perspective view showing a core module 100 according to one embodiment of the present invention.

The core module 100 is comprised of the upper core panel 110 and a lower core panel 120, each having a regular thickness and a polygonal horizontal-section. The polygonal horizontal-section shown in FIG. 2 is a regular triangular horizontal-section, however the shape of the horizontal-section is not limited to the shape shown in FIG. 2.

The core module 100 is configured such that predetermined portions thereof including multiple vertexes in the polygonal section are chamfered.

More specifically explained, the upper core panel 110 includes a first upper core panel chamfered portion 111, a second upper core panel chamfered portion 112, and a third upper core panel chamfered portion 113.

The upper core panel 110 has outer side surfaces 114, 115, and 116.

The outer side surfaces 114, 115, and 116 are formed along the periphery of each of the chamfered upper and lower core panels 110 and 120.

The outer side surface that is referred to as a first upper core panel outer side surface 114 allows the first upper core panel chamfered portion 111 and the second upper core panel chamfered portion 112 to be connected to each other.

The outer side surface that is referred to as a second upper core panel outer side surface 115 allows the second upper core panel chamfered portion 112 and the third upper core panel chamfered portion 113 to be connected to each other.

The outer side surface that is referred to as a third upper core panel outer side surface 116 allows the third upper core panel chamfered portion 113 and the first upper core panel chamfered portion 111 to be connected to each other.

Each of the chamfered portions may be formed to be parallel to at least one of the outer side surfaces of a vertical-section of the upper core panel 110 or the lower core panel 120.

In other words, the first upper core panel chamfered portion 111 is opposed to the second upper core panel outer side surface 115.

The second upper core panel chamfered portion 112 is opposed to the third upper core panel outer side surface 116.

The third upper core panel chamfered portion 113 is opposed to the first upper core panel outer side surface 114.

The lower core panel 120 has chamfered portions the same as those of the upper core panel 110.

In other words, the lower core panel 120 is also configured such that predetermined portions thereof including three vertexes are chamfered.

In other words, the lower core panel 120 has a first lower core panel chamfered portion 121, a second lower core panel chamfered portion 122, and a third lower core panel chamfered portion 123.

Figure 3:
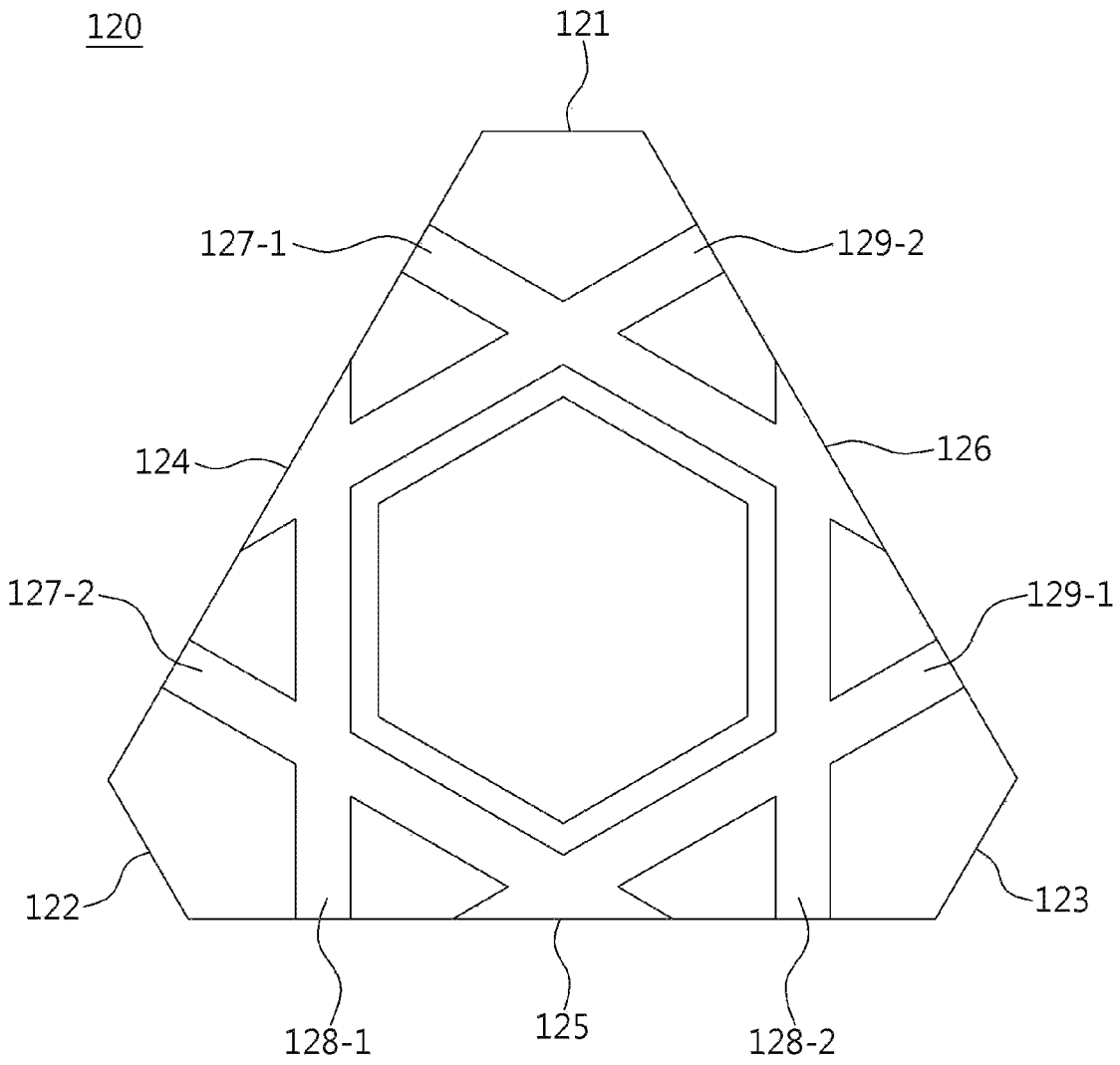
FIG. 3 is a bottom view showing a lower core panel 120 according to one embodiment of the present invention.

FIG. 3 is a bottom view showing the lower core panel 120 according to one embodiment of the present invention.

The core module 100 has a space 140 defined therein between the upper core panel 110 and the lower core panel 120 which are spaced apart from each other.

The side panel 400 allows the upper core panel 110 and the lower core panel 120 to be vertically connected to each other.

More specifically explained, the side panel 400 and the lower core panel 120 are vertically connected to each other at respective positions corresponding to the first upper core panel chamfered portion 111, the second upper core panel chamfered portion 112, and the third upper core panel chamfered portion 113.

The side panel 400 has a first side connected to the chamfered portions 111, 112, and 113 of the upper core panel 110 and a second side coupled to the chamfered portions 121, 122, and 123 of the lower core panel 120.

More specifically explained, the side panel 400 includes a first side panel 410, a second side panel 420, and a third side panel 430.

The first side panel 410 allows the first upper core panel chamfered portion 111 and the first lower core panel chamfered portion 121 to be vertically connected to each other.

The second side panel 420 allows the second upper core panel chamfered portion 112 and the second lower core panel chamfered portion 122 to be vertically connected to each other.

The third side panel 430 allows the third upper core panel chamfered portion 113 and the third lower core panel chamfered portion 123 to be vertically connected to each other.

Meanwhile, the lower core panel 120 is provided with a fork insertion space defined in a lower surface thereof such that the forks of a forklift are inserted thereinto when the core module 100 is moved.

The fork insertion space is comprised of a first fork insertion portion 127-1, a second fork insertion portion 127-2, a third fork insertion portion 128-1, a fourth fork insertion portion 128-2, a fifth fork insertion portion 129-1, and a sixth fork insertion portion 129-2.

The fork insertion space may be depressed in the lower surface of the lower core panel 120 in a straight line.

The first fork insertion portion 127-1 and the second fork insertion portion 127-2 are parallel to each other, and the third fork insertion portion 128-1 and the fourth fork insertion portion 128-2 are parallel to each other, while the fifth fork insertion portion 129-1 and the sixth fork insertion portion 129-2 are parallel to each other.

Figure 4:
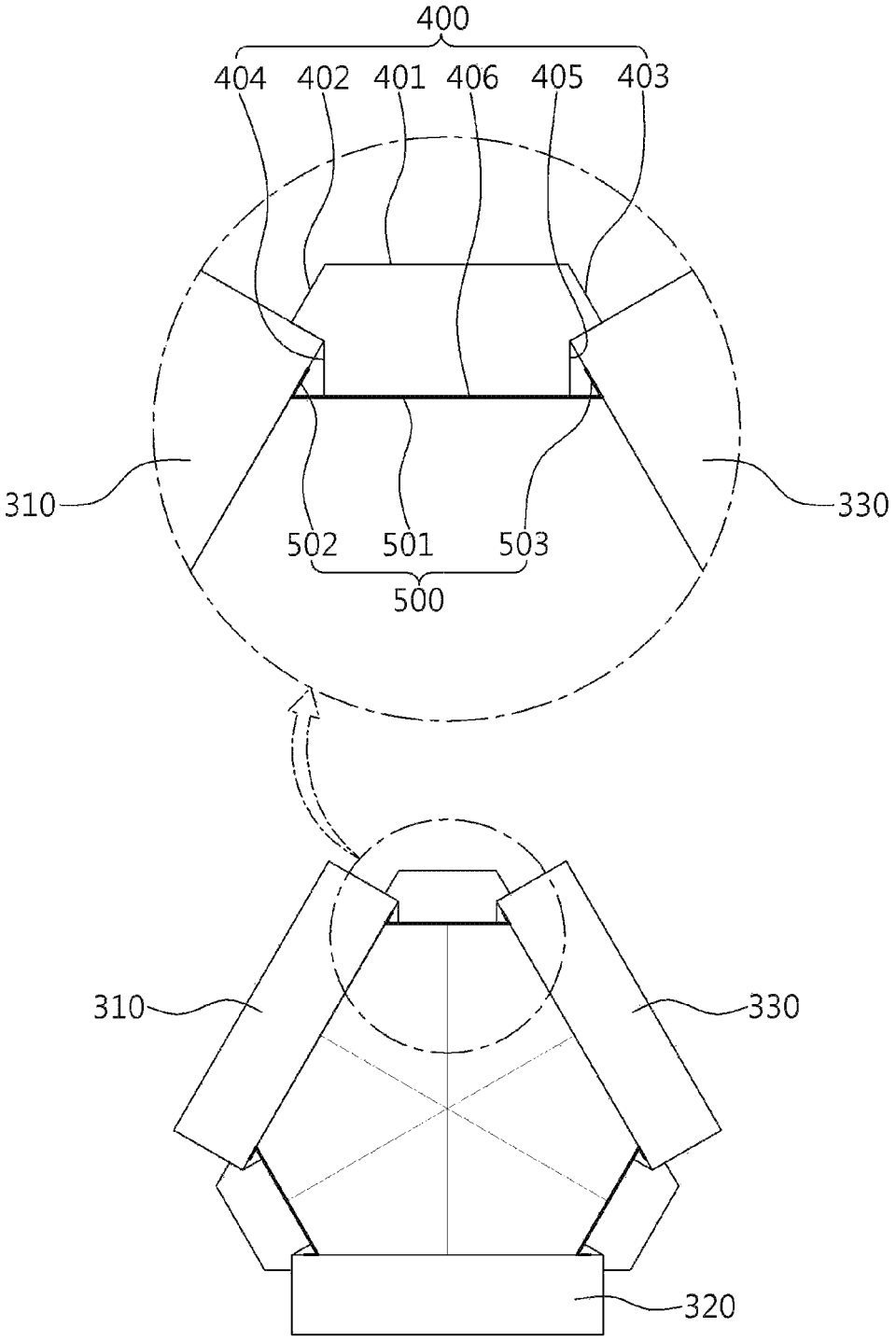
FIG. 4 is a view showing a connection between an expansion module and a side panel according to the preferred embodiment of the present invention.

FIG. 4 is a view showing a connection between an expansion module and the side panel according to the preferred embodiment of the present invention.

A first expansion module 310 is referred to as a first expansion module M1, a second expansion module 320 is referred to as a second expansion module M2, and a third expansion module 330 is referred to as a third expansion module M3.

The side panel 400 is provided between the first expansion module 310 and the second expansion module 320.

An inner securing panel 500 is coupled to the side panel 400 while in a state of being in surface contact with an inner surface of the first expansion module 310 and an inner surface of the third expansion module 330.

More specifically explained, the inner securing panel 500 includes a securing portion 501, a first flange portion 502, and a second flange portion 503.

The securing portion 501 has opposite ends provided with the first flange portion 502 and the second flange portion 503, respectively.

The first flange portion 502 is in surface contact with the inner surface of the first expansion module 310 while the second flange portion 503 is in surface contact with the inner surface of the third expansion module 330.

The side panel 400 includes a first surface 401, a second surface 402, a third surface 403, a fourth surface 404, a fifth surface 405, and a sixth surface 406.

The second surface 402 is in close contact with a side surface of the first expansion module 310 while the third surface 403 is in close contact with a side surface of the third expansion module 330.

The fourth surface 404 extends from the second surface 402, and the fifth surface 405 extends from the third surface 403.

The sixth surface 406 is in surface contact with the securing portion 501.

Each of the first surface 401 and the sixth surface 406 may be parallel to the first upper core panel chamfered portion 111.

Each of the second surface 402 and the third surface 403 may have an inclination with respect to the first surface 401.

Figure 5:
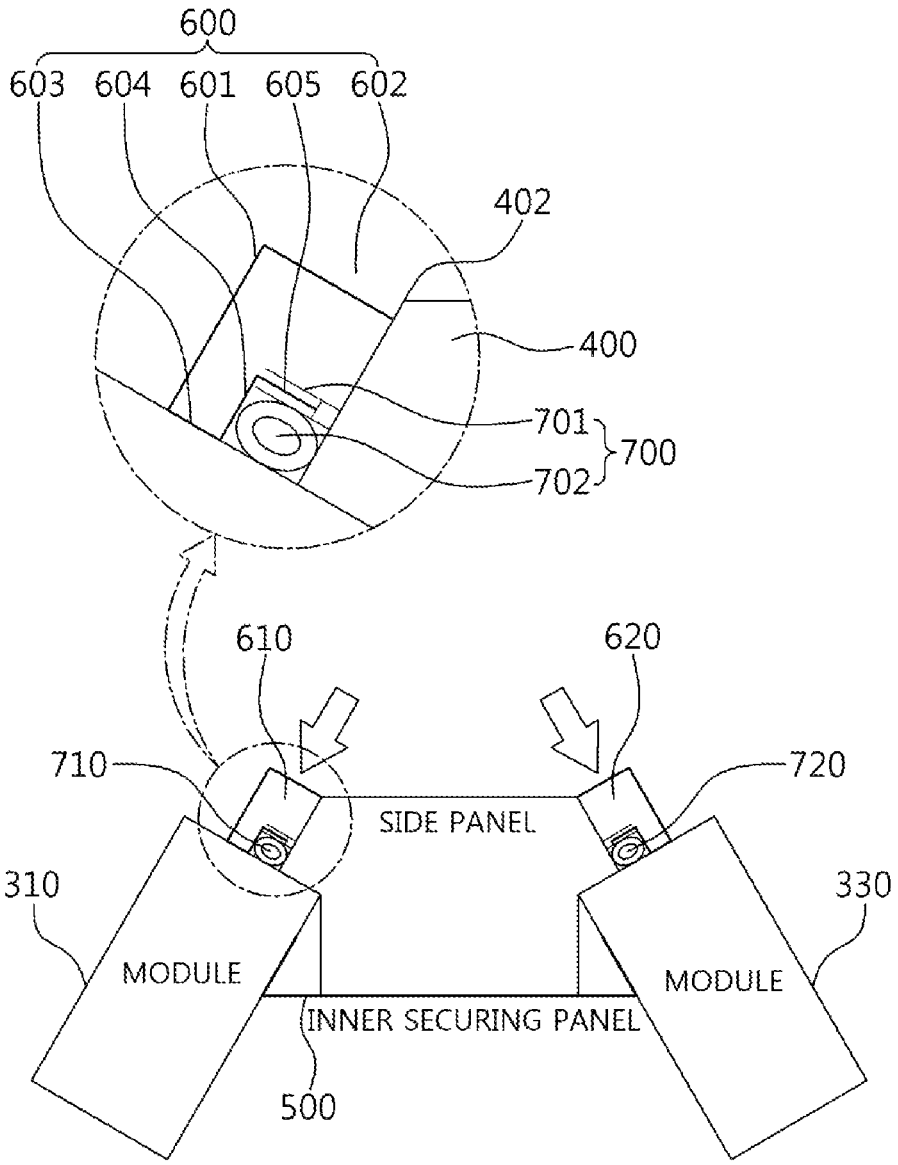
FIG. 5 is a cross-sectional view showing a sealing frame 600 coupled between the expansion module and the side panel according to the preferred embodiment of the present invention.

FIG. 5 is a cross-sectional view showing a sealing frame 600 coupled between the expansion module and the side panel according to the preferred embodiment of the present invention.

The sealing frame 600 includes a first portion 601, a second portion 602, a third portion 603, a fourth portion 604, and a fifth portion 605.

The third portion 603 is in close contact with an end portion of the first expansion module 310.

The fourth portion 604 extends vertically from the third portion 603, and the fifth portion 605 extends from the fourth portion 604 to be bent toward the side panel 400.

The first portion 601 extends vertically from the third portion 603 to be spaced apart from the fourth portion 604 by a predetermined interval.

The first portion 601 is greater in length than the fourth portion 604.

The second portion 602 extends from the first portion 601 to be bent toward the side panel 400.

The second portion 602 is greater in length than the fourth portion 604.

The second portion 602 and the fourth portion 604 may be configured such that end portions thereof are not connected to each other.

The second portion 602 is in contact with the second surface 402.

A sealing member 700 includes a first sealing portion 701 and a second sealing portion 702.

The first sealing portion 701 is coupled to the fifth portion 605, and the second sealing portion 702 is connected to the first sealing portion 701.

More specifically explained, the second sealing portion 702 may have a hollow annular cross section and may be a flexible tube made of an elastic material.

The second sealing portion 702 is in contact with an outer surface of the first expansion module 310, the fourth portion 604, and the second surface 402 such that the airtightness between the first expansion module 310 and the side panel 400 is maintained.

A first sealing member 710 is coupled between the outer side surface of the first expansion module 310 and the side panel 400, and a second sealing member 720 is coupled between an outer side surface of the third expansion module 330 and the side panel 400.

The first sealing member 710 and the second sealing member 720 may have the same configuration as that of the sealing member 700 described above.

Thus, when the side panel 400 is coupled between the first expansion module 310 and the third expansion module 330 by the inner securing panel 500, the first and second sealing members 710 and 720 block gaps between the first and third expansion modules 310 and 330 and the side panel 400, thus maintaining the airtightness therebetween.

Figure 6A:
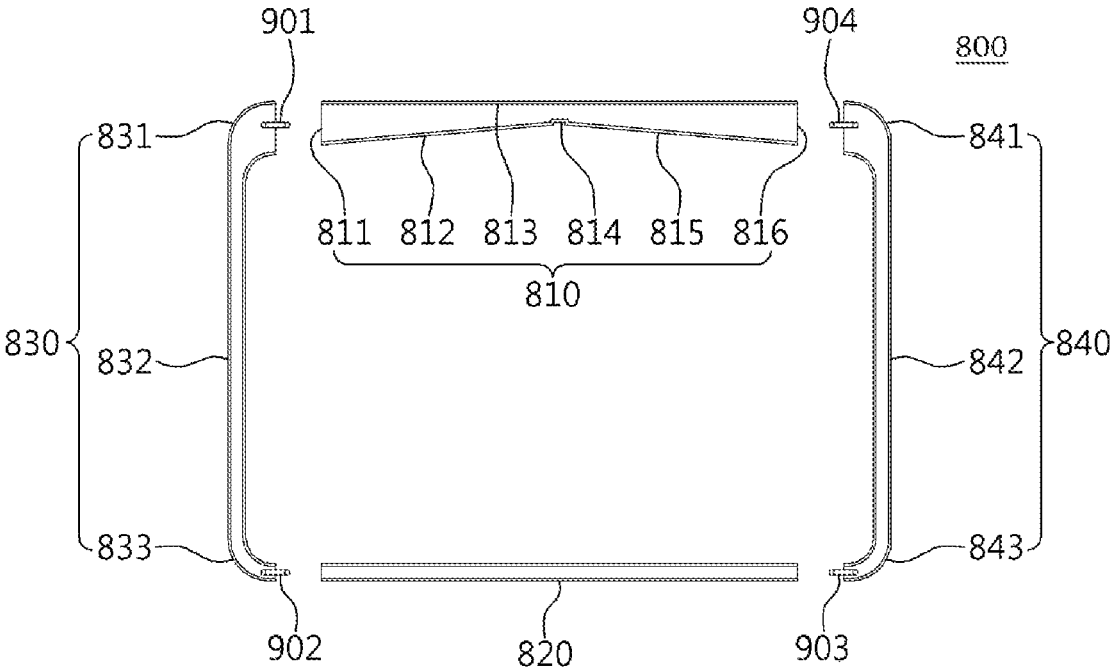
FIG. 6A and FIG. 6B are sectional view showing a sealing frame 800 according to another embodiment of the present invention.
Figure 6B:
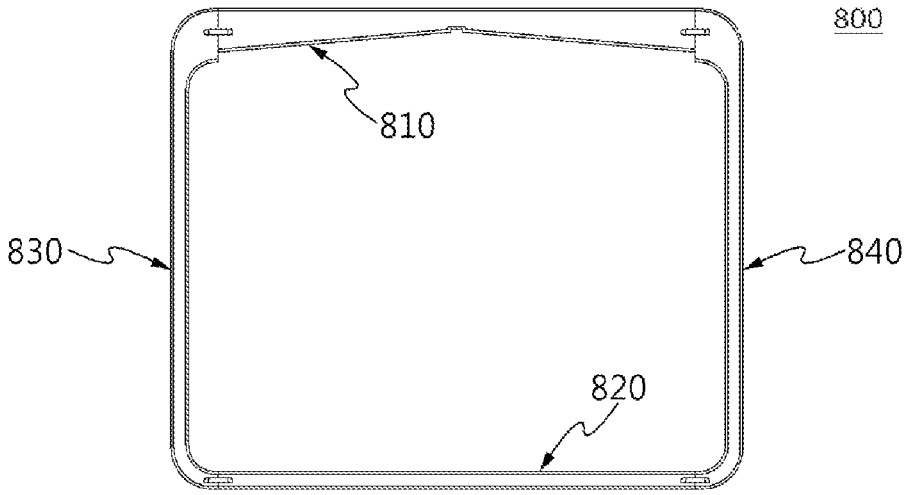

FIG. 6A and FIG. 6B are a sectional view showing a sealing frame 800 according to another embodiment of the present invention.

Figure 7A:
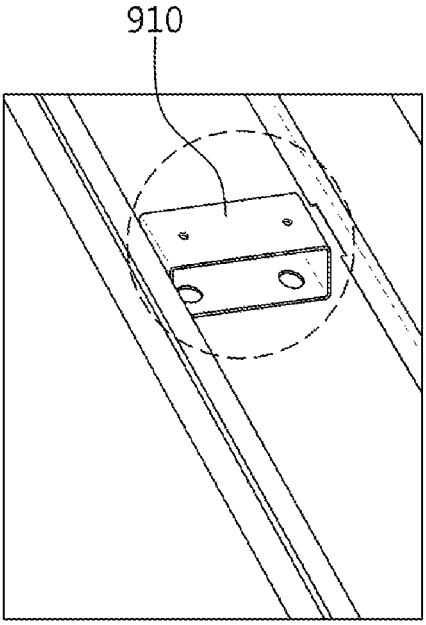
FIG. 7A, FIG. 7B and FIG. 7C are view showing a reinforcing member 910 according to yet another embodiment of the present invention.
Figure 7B:
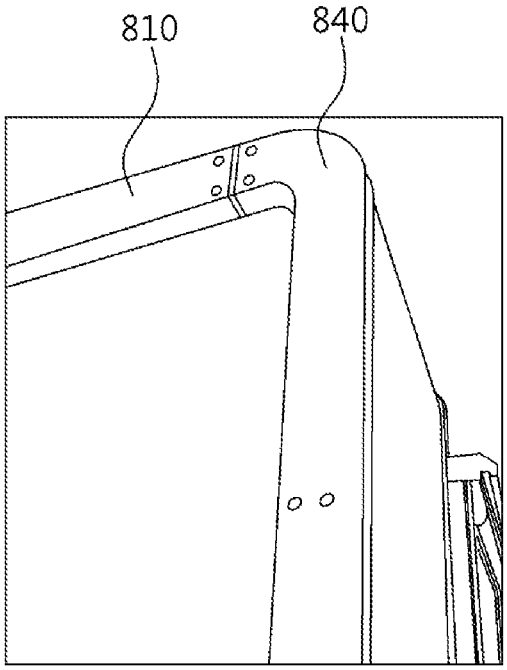
Figure 7C:
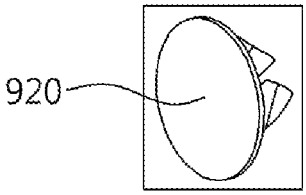

FIG. 7A, FIG. 7B and FIG. 7C are a view showing a reinforcing member 910 according to yet another embodiment of the present invention.

The sealing frame 800 is coupled to a coupling portion of the expansion module and the core module, thus blocking a gap therebetween.

More specifically explained, the sealing frame 800 is comprised of an upper sealing frame 810, a lower sealing frame 820, a first side sealing frame 830, and a second side sealing frame 840.

The upper sealing frame 810 has a first end 811, a first lower surface 812, an upper surface portion 813, a central portion 814, a second lower surface 815, and a second end 816 and is in close contact with the upper core panel 110.

The upper surface portion 813 defines an upper surface of the upper sealing frame 810, and the central portion 814 defines the center of a lower surface of the upper sealing frame 810.

The first end 811 is a vertical-section that defines a first end portion of the upper sealing frame 810, and the second end 816 is a vertical-section that defines a second end portion of the upper sealing frame 810.

The central portion 814 is recessed toward the upper surface portion 813.

The first lower surface 812 inclinedly extends from the central portion 814 toward the first end 811.

The second lower surface 815 inclinedly extends from the central portion 814 toward the second end 816.

The lower sealing frame 820 is in close contact with the lower core panel 120 and may have a vertical-section having a regular diameter.

The first side sealing frame 830 and the second side sealing frame 840 are symmetrical to each other and may have the same shape.

More specifically explained, the first side sealing frame 830 includes a first upper end portion 831, a first vertical portion 832, and a first lower end portion 833.

The first vertical portion 832 extends vertically and is configured such that upper and lower end portions thereof are provided with the first upper end portion 831 and the first lower end portion 833, respectively.

The first upper end portion 831 is rounded toward the first end 811, and the first lower end portion 833 is rounded toward a first end portion of the lower sealing frame 820.

The second side sealing frame 840 includes a second upper end portion 841, a second vertical portion 842, and a second lower end portion 843.

The second vertical portion 842 extends vertically and is configured such that upper and lower end portions thereof are provided with the second upper end portion 841 and the second lower end portion 843, respectively.

The second upper end portion 841 is rounded toward the second end 816, and the second lower end portion 843 is rounded toward a second end portion of the lower sealing frame 820.

A first spring 901 has a first side connected to the first upper end portion 831 and a second side connected to the first end 811.

A second spring 902 has a first side connected to the first lower end portion 833 and a second side connected to the first end portion of the lower sealing frame 820.

The first spring 901 exerts an elastic force such that the first side sealing frame 830 is in close contact with the upper sealing frame 810.

The second spring 902 exerts an elastic force such that the first side sealing frame 830 is in close contact with the lower sealing frame 820.

A fourth spring 904 has a first side connected to the second upper end portion 841 and a second side connected to the second end 816.

A third spring 903 has a first side connected to the second lower end portion 843 and a second side connected to the second end portion of the lower sealing frame 820.

The fourth spring 904 exerts an elastic force such that the second side sealing frame 840 is in close contact with the upper sealing frame 810.

The third spring 903 exerts an elastic force such that the first side sealing frame 830 is in close contact with the lower sealing frame 820.

Meanwhile, the sealing frame 600 described above may correspond to a cross-section of the first vertical portion 832 and a cross-section of the second vertical portion 842.

The reinforcing member 910 is provided with a hole into which a screw is inserted and is secured to an inner surface of each of the upper sealing frame 810, the lower sealing frame 820, the first side sealing frame 830, and the second side sealing frame 840.

More specifically explained, each of the upper sealing frame 810, the lower sealing frame 820, the first side sealing frame 830, and the second side sealing frame 840 has a securing hole formed therein to be positioned on a straight line with the hole formed in the reinforcing member 910, the securing hole into which a securing screw is inserted.

A stopper 920 blocks the securing hole formed in each of the upper sealing frame 810, the lower sealing frame 820, the first side sealing frame 830, and the second side sealing frame 840.

Figure 8A:
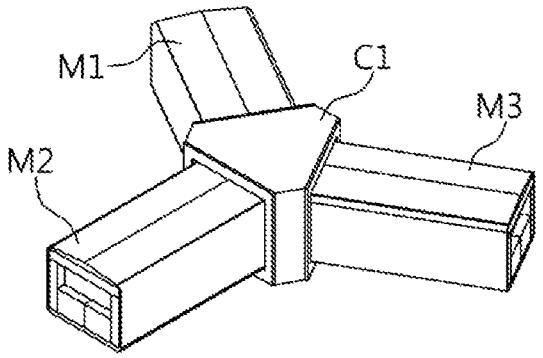
FIG. 8A, FIG. 8B and FIG. 8C are view showing coupling variation of the expansion module according to the present invention.
Figure 8B:
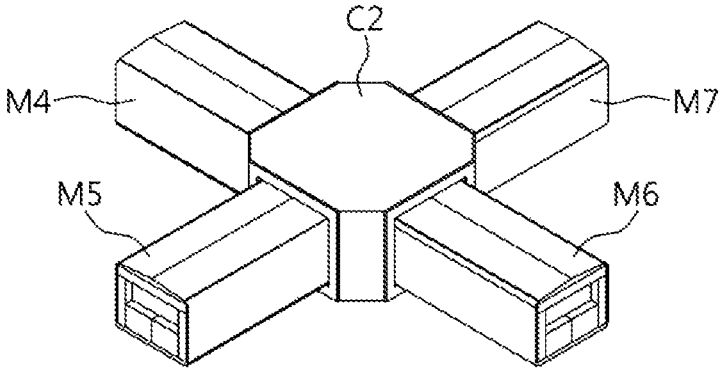
Figure 8C:
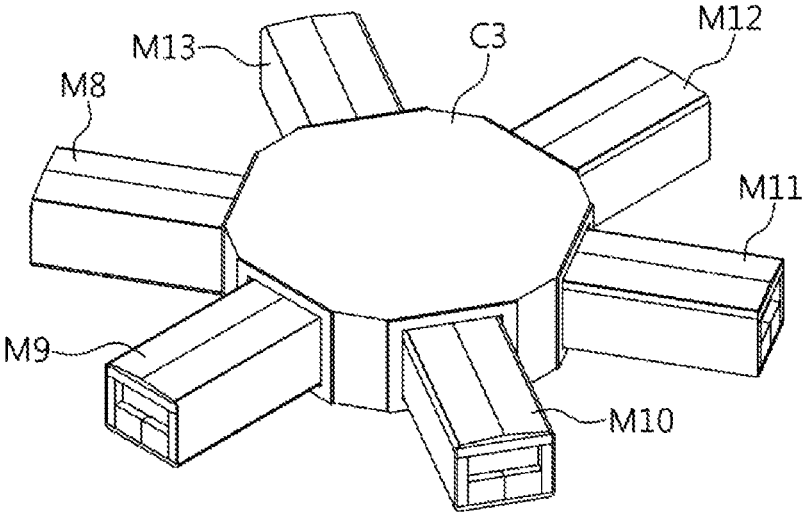

FIG. 8A, FIG. 8B and FIG. 8C are a view showing coupling variation of the expansion module according to the present invention.

Each of the expansion modules M1 to M13 has a rectangular parallelepiped shape, and the rectangular parallelepiped is configured such that the vertical section thereof has a regular thickness in four directions and a space is defined therein.

The expansion modules may all be the same in size and specification.

The expansion module may be provided at an upper portion thereof with a solar panel capable of converting the light of the sun into electric energy.

The expansion module may have an upper roof having an inclination.

The number of the expansion modules that are connectable is equal to one half of the number N of the outer side surfaces.

For example, as shown in FIG. 8A, when the core module 100 is triangular in horizontal-section (C1), the number of the outer side surfaces is six and three expansion modules M1, M2, and M3 are connectable to the core module 100.

Meanwhile, as shown in FIG. 8B, when the core module 100 is rhombic or quadrangular in horizontal-section (a second core module C2), the number of the outer side surfaces is eight and a total of four expansion modules (the fourth expansion module M4, the fifth expansion module M5, the sixth expansion module M6, and the seventh expansion module M7) are connectable to the core module 100.

As shown in FIG. 8C, when the core module 100 is hexagonal in horizontal-section (C3), the number of the outer side surfaces is twelve and a total of six expansion modules (the eighth expansion module M8, the ninth expansion module M9, the tenth expansion module M10, the eleventh expansion module M11, the twelfth expansion module M12, and the thirteenth expansion module M13) are connectable to the core module 100.

Each of the expansion modules may be configured such that a first end portion thereof is in surface contact with the outer side surfaces while a second end portion thereof is coupled to another core module.

For example, the second expansion module M2 may be coupled to the second core module C2 at the position of the fifth expansion module M5 coupled to the second core module instead of the fifth expansion module M5.

Herein, a first core module C1 is connectable to the second core module C2 in a state where the first expansion module M1, the second expansion module M2, and the third expansion module M3 are connected to the first core module, the second core module to which the fourth expansion module M4, the sixth expansion module M6, and the seventh expansion module M7 are connected.

Alternatively, the second expansion module M2 may be coupled to a third core module C3 at the position of the tenth expansion module M10 coupled to the third core module instead of the tenth expansion module M10.

Herein, the first core module C1 is connectable to the third core module C3 in a state where the first expansion module M1, the second expansion module M2, and the third expansion module M3 are connected to the first core module, the third core module to which the eighth expansion module M8, the ninth expansion module M9, the eleventh expansion module M11, the twelfth expansion module M12, and the thirteenth expansion module M13 are connected.

Meanwhile, it is preferable that an angle between the expansion modules is 720/N.

In this case, the angle is defined by virtual lines passing through the central axes of adjacent expansion modules of the N expansion modules.

For example, the first core module C1 has three expansion modules M1, M2, and M3, and an angle between the central axis of the M1 and the central axis of M2 is a 120 degree angle.

Meanwhile, the upper core panel 110 may be a combination of six panels having the same shape.

Figure 9:
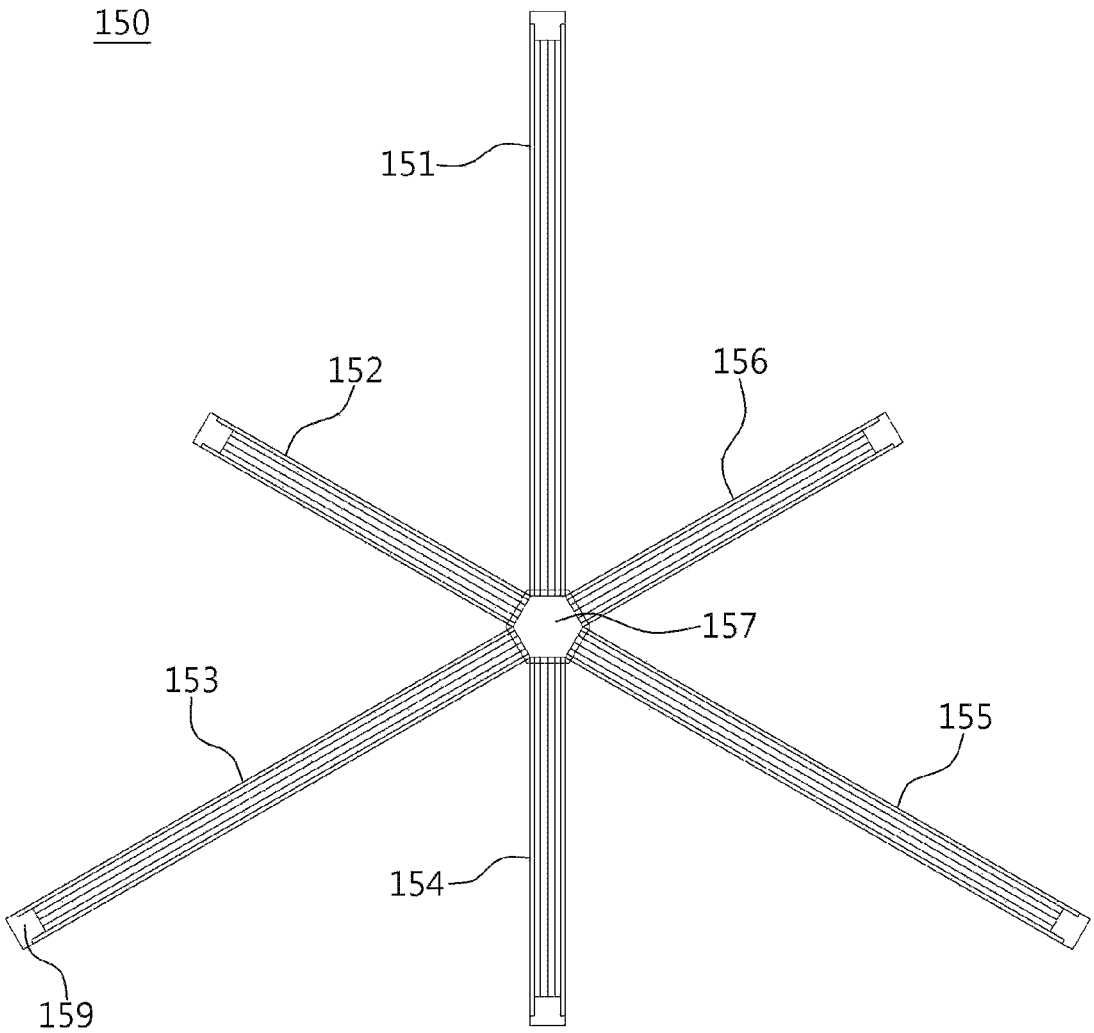
FIG. 9 is a skeleton of the upper core panel 110 according to the present invention.

FIG. 9 is a skeleton of the upper core panel 110 according to the present invention.

More specifically explained, the upper core panel 110 includes a first coupling member 151, a second coupling member 152, a third coupling member 153, a fourth coupling member 154, a fifth coupling member 155, and a sixth coupling member 156.

A coupling member 150 may partially constitute the upper core panel 110.

A connecting member 157 is centrally provided. The connecting member 157 may have a cube shape having a coupling portion formed at a side surface thereof.

Each of the first coupling member 151, the second coupling member 152, the third coupling member 153, the fourth coupling member 154, the fifth coupling member 155, and the sixth coupling member 156 has a first end coupled to the connecting member 157.

A finishing member 159 is coupled to a second end of each of the first coupling member 151, the second coupling member 152, the third coupling member 153, the fourth coupling member 154, the fifth coupling member 155, and the sixth coupling member 156.

The first coupling member 151, the third coupling member 153, and the fifth coupling member 155 are the same in length and shape.

The first coupling member 151 and the fourth coupling member 154 are located on a straight line with each other.

The second coupling member 152 and the fifth coupling member 155 are located on a straight line with each other.

The sixth coupling member 156 and the third coupling member 153 are also located on a straight line with each other.

Meanwhile, the second coupling member 152, the fourth coupling member 154, and the sixth coupling member 156 are the same in length and shape.

An upper plate (not shown) may be coupled between the first coupling member 151 and the second coupling member 152, between the second coupling member 152 and the third coupling member 153, between the fourth coupling member 154 and the fifth coupling member 155, and between the sixth coupling member 156 and the first coupling member 151, and the overall shape thereof may be the same as in FIG. 1

What is claimed is:

1. An assemblable panel structure, comprising:

a core module which comprises:

an upper core panel, a lower core panel, and a side panel, wherein each of the upper and lower core panels has a regular thickness and a polygonal horizontal-section, the core module has a space defined therein between the upper core panel and the lower core panel which are spaced apart from each other, predetermined portions of the core module including multiple vertexes in the polygonal section are chamfered such that each of the upper core panel and the lower core panel has chamfered portions, the side panel is provided such that a first end of the side panel is connected to the chamfered predetermined portion of the upper core panel and a second end of the side panel is connected to the chamfered predetermined portion of the lower core panel, and the lower core panel is provided with a fork insertion space defined in a lower surface thereof such that forks of a forklift are inserted thereinto and the fork insertion space is depressed in the lower surface of the lower core panel in plural straight lines which are crossing each other.

2. The assemblable panel structure of claim 1, wherein outer side surfaces are formed along a periphery of each of the chamfered upper and lower core panels, and expansion modules are provided such that the number of the expansion modules that are connectable to the core module is equal to one half of the number (N) of the outer side surfaces.

3. The assemblable panel structure of claim 2, wherein each of the expansion modules has a rectangular parallelepiped shape, and the rectangular parallelepiped shape is configured such that a vertical-section thereof has a regular thickness in four directions and a space is defined therein.

4. The assemblable panel structure of claim 3, wherein the core module further comprises an inner securing panel which is coupled to the side panel, and wherein at least one of the expansion modules is configured such that an inner surface thereof is in surface contact with a surface of the inner securing panel.

5. The assemblable panel structure of claim 4, wherein at least one of the expansion modules is configured such that a second end portion thereof is coupled to another core module.

6. The assemblable panel structure of claim 3, wherein an angle between the expansion modules is 720/N.

7. The assemblable panel structure of claim 6, wherein the angle is defined by virtual lines passing through central axes of adjacent expansion modules of the N expansion modules.

8. The assemblable panel structure of claim 1, wherein the polygonal horizontal section is a triangular horizontal-section.

9. The assemblable panel structure of claim 1, wherein each of the chamfered portions is formed to be parallel to at least one of the outer side surface of a vertical-section of the upper core panel or the outer side surface of a vertical-section of the lower core panel.

* * * * *